US005708984A

United States Patent [19]

Shofner

[11] Patent Number: 5,708,984

[45] Date of Patent: Jan. 20, 1998

[54] SOCKS WITH COLOR INDICATORS TO FACILITATE MATCHING OF COMPONENTS OF A PAIR

[76] Inventor: Michael Monroe Shofner, 1715 Wartrace Pike, Shelbyville, Tenn. 37160

[21] Appl. No.: 721,236

[22] Filed: Sep. 26, 1996

Related U.S. Application Data

[63] Continuation-in-part of Ser. No. 546,603, Oct. 23, 1995, abandoned.

[51] Int. Cl.[6] ..... A41B 11/01

[52] U.S. Cl. ..... 2/239; 2/275

[58] Field of Search ..... 2/239, 22, 241, 2/242, 244, 246, 275, 243.1; D2/980, 991, 994, 985; 24/DIG. 29; 66/178 R, 180, 182, 185, 186, 187

[56] References Cited

U.S. PATENT DOCUMENTS

| | | | |
|---|---|---|---|
| D. 208,623 | 9/1967 | Jensen | D2/994 |
| 2,002,888 | 5/1935 | Gastrich | 66/182 |
| 2,569,434 | 9/1951 | Ischinger | 66/178 |
| 2,621,501 | 12/1952 | Jenkins | 66/171 |
| 2,798,281 | 7/1957 | Herzog | 28/74 |
| 2,980,917 | 4/1961 | Slane | 2/239 |
| 3,324,686 | 6/1967 | Rosenstein | 66/187 |
| 4,104,892 | 8/1978 | Thorneburg | 66/185 |
| 4,958,388 | 9/1990 | Madden, III | 2/239 |

OTHER PUBLICATIONS

Tringali, Richard, "A Close Look at Hosiery Toe Seaming", Union Special Machine Company, pp. 28–29, Apr. 1961.

*Primary Examiner*—Amy B. Vanatta
*Attorney, Agent, or Firm*—Chambliss, Bahner & Stophel, P.C.

[57] ABSTRACT

An improved pair of socks is disclosed for human feet. The improvement comprises providing a distinctive color indicator on each sock of the pair, in a location that will be covered by the shoe of the wearer, to facilitate pairing of the socks which comprise the pair, wherein the color of the indicator is selected so as to be capable of distinguishing the socks of the pair from other socks of similar or like color and of the same size. A process is also disclosed for making pairs of socks of a predetermined size including a color indicator for facilitating pairing of socks.

7 Claims, 3 Drawing Sheets

SOCKS WITH COLOR INDICATORS TO FACILITATE MATCHING OF COMPONENTS OF A PAIR

CROSS-REFERENCE TO RELATED APPLICATIONS

This application is a continuation-impart of the application filed on Oct. 23, 1995 and assigned the Ser. No. 08/546,603, which is directed to: Sock With Color Indicator To Facilitate Matching, now abandoned.

FIELD OF THE INVENTION

This invention is an improvement in socks and other items of hosiery that am provided in pairs. More particularly, the invention is an improvement in socks or stockings that permits such socks to be easily matched with their mates.

BACKGROUND OF THE INVENTION

Articles of clothing that serve as coverings for the human leg and foot have been known for many centuries. Such articles now in use include socks, stockings, pantyhose and tights. These garments are usually knitted from nylon or other synthetic fabrics, cotton or wool, and they may cover all or part of the legs of the wearer. The term "socks" is generally used to describe coverings for the feet and perhaps a part of the lower legs, whereas the terms "stockings", "pantyhose" and "tights" are generally used to describe coverings for the feet and all or substantially all of the legs. Socks and stockings are generally provided in pairs, one for each foot or leg, while pantyhose and tights are single garments in which the separate legs are joined at the waist.

As used hereinafter, however, the term "socks" includes socks, stockings and other items of hosiery that are provided in pairs and are designed to be worn on the feet, inside shoes or boots. Socks may be provided in a variety of colors and shades, and it is not uncommon for a person to own a number of pairs that are of similar, but not identical, colors. It is also not uncommon for a person to own a number of pairs of socks of the same color, but that are of a different texture or that have been worn and laundered a different number of times, so that they may exhibit slightly different appearances. In such circumstances, the matching or pairing of the mating components of a pair of socks can be difficult.

Devices such as plastic rings have been developed for holding the mating components of a pair of socks together as they are laundered. Such rings generally include appendages that project radially inwardly towards the center thereof, which retain a portion of a pair of socks that are forced therethrough. However, such appendages may snag and cause runs in nylon or other delicate socks. In addition, the use of such devices interferes with the laundering of socks by holding at least a portion of a pair of socks in very close proximity, so that water and detergent cannot readily contact and pass through the fabric of the socks. Finally, in order for such devices to be useful, they must be available at the time and place where the socks are removed, and wearers of socks may not find this necessity convenient.

Other means for matching the mating components or mates of a pair of socks together include snaps or other fasteners that may be incorporated into each of the socks, by means of which they may be joined together. However, such features may be unsuitable for use in connection with sheer or thin stockings. They may also be objectionable because the fasteners may be uncomfortable to the wearer of the socks. In addition, the appearance of such fasteners on socks may be objectionable.

It is also known to provide physical or visual indicators on socks for a variety of purposes, although not for the purpose of facilitating matching of the individual components of a pair of socks in such way that they may be distinguished from other socks of the same size and type, and of the same or similar color. Thus, for example, U.S. Pat. No. 3,324,686 of Rosenstein describes a sock having a visual indicating means for distinguishing the outside surface of the sock from its inside surface, in order to permit the wearer to determine whether the sock is right side out or wrong side out. However, nothing in the Rosenstein patent suggests that this visual indicating means is in any way capable of distinguishing the mating components of a pair of socks from other socks of the same size and the same or a similar color. Similarly, U.S. Pat. No. 4,104,892 of Thorneburg describes a cushioned tube sock having partial courses of terry loops on the inner surface of that part of the foot portion adapted to underlie the sole of a wearer's foot, while that part of the foot portion adapted to overlie the instep of a wearer's foot is devoid of terry loops. The sock also includes an indicia on the outer surface of the foot portion for indicating the proper manner in which the tube sock should be worn to correctly position the terry loops beneath the sole of the wearer's foot. Preferably, the indicia are provided in the form of stripes extending from one side to the other across the sole portion of the sock. However, nothing in the Thorneburg patent suggests that the means described therein for indicating the proper orientation for placing the sock on the wearer's foot is in any way capable of distinguishing the mating components of a pair of socks from other socks of the same size and of the same or a similar color. Finally, U.S. Pat. No. 2,621,501 of Jenkins and U.S. Pat. No. 4,958,388 of Madden describe socks that are provided with visual indicators for the purpose of distinguishing socks of one size from other socks of different sizes. The Jenkins patent describes a sock that is provided with a circular figure or other common geometric shape that is located on the heel, at the toe, or at any other conspicuous position, and the Madden patent describes a sock that is provided with a selected number of size-indicating stripes. The geometric figures of each Jenkins' sock and the size-indicating stripes of each Madden sock are formed by knitting differently colored yarns into the body portions of the socks. The color of the size-indicating means of each size is unique to that size; however, neither the Jenkins patent nor the Madden patent discloses or suggests how socks of an individual pair may be matched in a way that distinguishes the components of that pair from other socks of the same size and of the same or a similar color. In fact, the Jenkins' method and the Madden system for distinguishing sock sizes are incapable of distinguishing the components of a particular pair of socks from any other socks of the same size.

When socks are not properly matched with their mates, embarrassment can result. In addition, the components of a pair that have not been matched and kept together may be worn a different number of times, and consequently laundered a different number of times. This may make subsequent attempts at matching more difficult, because the components of the pair may not appear to be identical.

It would be desirable therefore, if a sock could be provided that can readily be matched with its mate without requiring the use of rings or other devices for holding the socks together. It would also be desirable if such a sock could be provided that can readily be matched with its mate without the necessity for a fastener that is incorporated in the sock and that attaches the mating components of the pair together. It would also be desirable if a sock could be provided with an improvement that is in a location that will be covered by the shoe of the wearer and that will facilitate matching of the sock with its mate from among a group of socks of similar color. It would also be desirable if a method could be provided for distinguishing the identical components in a matching pair of socks from socks of the same size and the same or similar color by providing distinguishing indicia on the components of the pair. Furthermore, it would also be desirable if such distinguishing indicia could be provided during the sock-manufacturing process without significantly increasing the cost or the complexity of the manufacturing process.

OBJECTS AND ADVANTAGES OF THE INVENTION

Accordingly, it is an object of the invention claimed herein to provide a sock that can readily be matched with its mate from among a group of socks of the same or a similar color. It is yet another object of the invention to provide a sock that can be matched with its mate, without the need for employing any device for mechanically holding the mating components of the pair of socks together. It is still another object of this invention to provide a sock that can be matched with its mate without requiring the use of any fastener that is incorporated in the sock. Another object of this invention is the provision of a sock having an improvement that is in a location that will be covered by the shoe of the wearer and that will facilitate matching of the sock with its mate from among a group of socks of the same or a similar color. Still another object of this invention is the provision of a method for distinguishing the identical components in a matching pair of socks from socks of the same size and the same or similar color by providing distinguishing indicia on the components of the pair. Finally, it is an object of this invention to provide an improved sock-manufacturing process that can produce pairs of socks having distinguishing indicia that will permit the individual components of a particular pair of socks to be distinguished from socks of the same size and the same or similar color without significantly increasing the cost or the complexity of the manufacturing process.

Additional objects and advantages of this invention will become apparent from an examination of the drawings and the ensuing description.

SUMMARY OF THE INVENTION

An improved pair of socks for human feet is provided. The improvement comprises providing a distinctive color indicator on each component of the pair in a location that will be covered by the shoe of the wearer, to facilitate pairing of each component of the pair with its mate, and to permit such members of the pair to be distinguished from other socks of the same size and the same or similar color.

In order to facilitate an understanding of the invention, the preferred embodiments of the invention are illustrated in the drawings, and a detailed description thereof follows. It is not intended, however, that the invention be limited to the particular embodiments described or to use in connection with the types of socks illustrated herein. Various changes are contemplated such as would ordinarily occur to one skilled in the art to which the invention relates. Various modifications and alternative embodiments such as would ordinarily occur to one skilled in the art to which the invention relates are also contemplated and included within the scope of the invention described herein.

DESCRIPTION OF THE PREFERRED EMBODIMENTS

Figure 1:
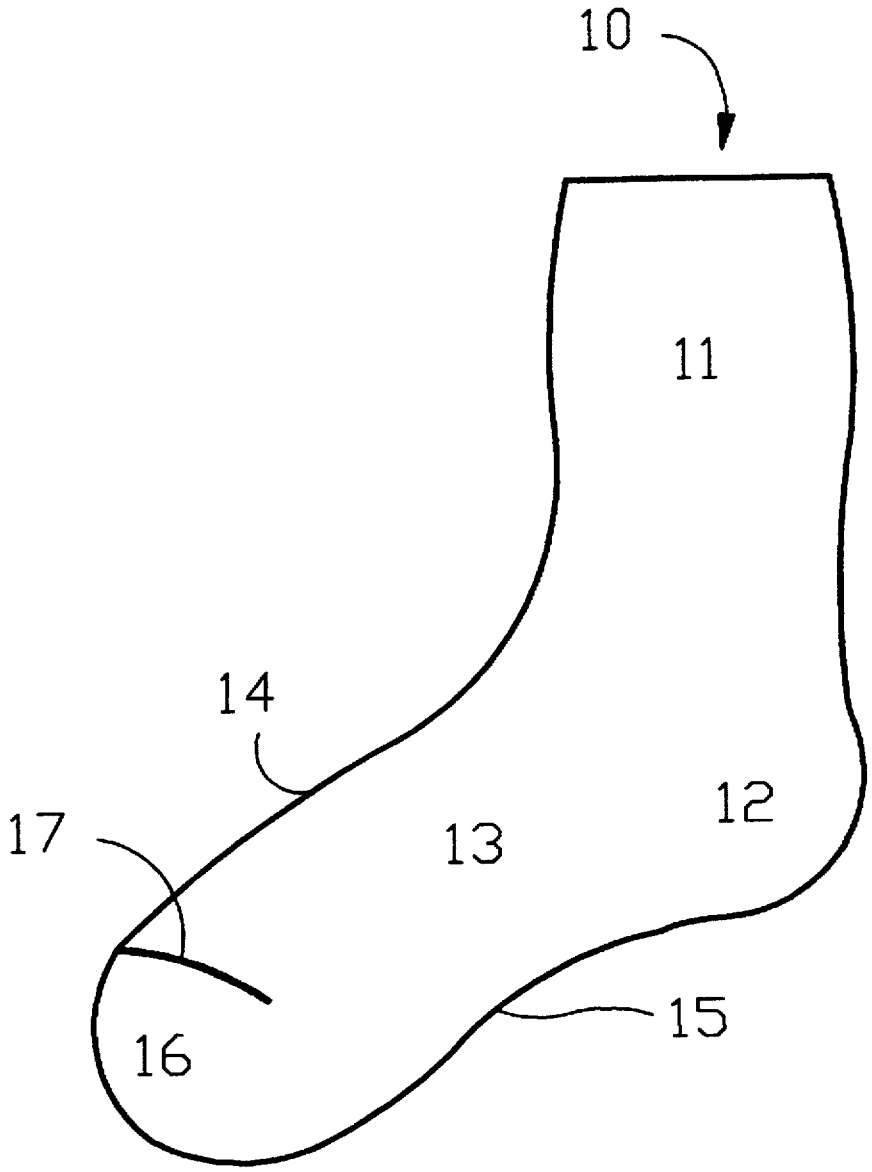
FIG. 1 is a perspective view of a sock which exhibits a preferred embodiment of the invention.

As shown in FIG. 1, sock 10 is an item of hosiery that is designed to be worn on the feet, inside shoes or boots. Sock 10 is one component of a matching pair of such items, with the mate thereto being essentially identical therewith (although not shown in the drawings).

Sock 10 may be an athletic sock or a dress sock, as the invention is suitable for use with both, as well as with socks and stockings of various lengths. Socks are generally knitted from cotton, wool, nylon or other synthetic fabrics, or blends of such fabrics, on a circular knitting machine that forms essentially straight knitted tubes that are open at each end. If synthetic fabrics are employed, the tube may have a general shape that conforms to the shape of the human foot, ankle and a portion of the leg (depending on the length of the tube). If cotton or wool is employed, the sock may be tube-shaped, only acquiring the general shape of the foot, ankle and leg upon being worn. In addition, socks may be knitted by hand or formed by other processes, and all such socks are suitable for improvement by the invention.

Sock 10 includes leg portion 11, heel portion 12, foot portion 13, with the instep indicated at 14 and the sole at 15, and toe portion 16. The toe end of a tube-shaped sock is generally closed with a stitched toe seam, such as seam 17 of FIG. 1. Such seams are frequently, although not always, provided using thread that is the same color as the dominant color of the remaining (tube) portion of the sock.

As mentioned previously, socks are provided in a variety of colors and shades, and it is not uncommon for a person to own a number of pairs that are of similar, but not identical colors. It is also not uncommon for a person to own a number of pairs that are essentially of the same color, but which are of a different texture, or which have been worn and laundered a different number of times. Such pairs may exhibit slightly different shades of the same color. In such circumstances, the matching or pairing of the mating components of a pair of socks can be difficult. Therefore, the invention provides an improved pair of socks that inherently facilitates matching each component of a pair with its mate. This is accomplished by providing a distinctive color indicator on each sock of the pair, in a location that will be covered by the shoe of the wearer. As used herein, "a distinctive color indicator" is anything that is capable of being distinguished by its color, as perceived by the human eye, from its surroundings. When mating components of a pair of socks are each provided with an identical distinctive color indicator, the individual socks can readily be matched with their mates from a group of socks of the same or similar colors.

Color, of course, is a matter of the perception of light that is reflected. Light from the noontime sun looks white, but if a ray of white light is aimed at a prism, a broad rainbow-like band or array of different colors appears. This color array is the visible spectrum, and it ranges, in order of wavelength, from violet, through blue, green, yellow and orange, to red. Each color is associated with a range of wavelengths. Thus, for example, a wide segment of the spectrum contains colors that are called green. These include blue-green, apple green and chartreuse, as well as many others. A particular color can be specified by its wavelength, but colors of nearly the same wavelength look exactly alike to the human eye. Therefore, color classification systems have been developed to identify colors that may be distinguished by the human eye.

One such system is the Munsell system of color classification, which is described in many references, including The New Encyclopedia Britannica, 15th edition, at volume 8, page 420. The Munsell system arranges colors according to three qualities: hue, value and chroma. Hue is what is usually meant by the word color. The Munsell system divides all hues into ten categories: yellows, green-yellows, greens, blue-greens, blues, purple-blues, purples, red-purples, reds and yellow-reds. Value is the Munsell term for the lightness or darkness of a color sample. A yellow sample may be light, while a blue sample may be dark. A series of grays, from black to white, best define value. Chroma defines the amount of hue in a sample. A brick and a red apple, for example, may have the same red hue and value, but their difference in color is a difference in chroma.

Socks are not generally made to be truly transparent to all wavelengths of light. Therefore, most, if not all, socks exhibit a color that is perceived by the human eye as the dominant color, even if they are patterned or variegated.

Although white (which is a mixture of all colors in the spectrum) and black (which is the absence of color) are not true colors or hues, they are generally considered to be included among the colors that may be applied to socks, and hence white and black may be considered to be among the dominant colors of socks. Furthermore, the distinctive color indicator of the invention may be black or white as well, so long as the color selected is capable of being distinguished from the surrounding portion of the sock.

Referring again to FIG. 1, sock 10 includes as its distinctive color indicator, according to the invention, the thread that is utilized to form toe-seam 17, which thread is provided in a distinctive color, which may be black, white, or of any color that can be distinguished from the surrounding portion of the sock. Preferably, the thread which serves as the distinctive color indicator in this embodiment of the invention has a hue that is different, according to the Munsell system of color classification, from the dominant color of the sock. In other words, the sock exhibits a dominant color that may be characterized as either black, white, yellow, green-yellow, green, blue-green, blue, purple-blue, purple, red-purple, red or yellow-red, and the thread which serves as the distinctive color indicator exhibits a color or hue that is different from the color or hue of the dominant color of the sock and which may be characterized as either black, white, yellow, green-yellow, green, blue-green, blue, purple-blue, purple, red-purple, red or yellow-red.

By providing the distinctive color indicator of the socks in the form of the thread that forms the toe seam, as in a preferred embodiment of the invention, changes in the normal sock-manufacturing practice are minimized. Thus, in a process for making such pairs of socks wherein each sock in the pair exhibits a dominant first color and wherein a toe seam is stitched into the toe end of each sock, a second color that may be distinguished from the first color is selected for the thread that is utilized to form the toe seam, and the toe seam of a predetermined number of pairs of socks is stitched using thread of the second color, so that the toe seam of each sock of each such pair may serve as an indicator to facilitate matching of the components of the pair. Thereafter, according to a preferred embodiment of the invention, additional colors are selected for the thread that forms the toe seam. Each such additional color must be distinguished from the dominant first color and the second color, and from each other additional color selected. After each predetermined number of pairs of socks exhibiting a particular dominant color are seamed at the toe with thread having a particular distinctive color, the thread in the seaming machine may be changed so that another group of pairs may be seamed at the toe with thread having a different distinctive color. The toe seam of each sock of each such pair may then serve as an indicator to facilitate matching of the components of the pair, and the components of any such pair of socks may be distinguished from components of other pairs having toe seams of a different color, even though they all may exhibit the same or a similar dominant first color.

Preferably, each color selected for the toe seam for a number of pairs of socks made according to this process is of a different hue, according to the Munsell system of color classification, than the dominant first color, as well as each other color selected for the toe seams of a different group of pairs of socks. Thus for example, if the dominant first color of a particular group of pairs of socks is black, a number of toe seam colors may be selected, including white, yellow, green-yellow, green, blue-green, blue, purple-blue, purple, red-purple, red and yellow-red. Each such color may serve to identify the matching components of a pair of black socks, and may be used to distinguish a particular pair from other socks of the same or similar color.

A purchaser who wanted several pairs of black socks could buy one pair with a white toe seam, one pair with a yellow seam, and one pair with a green seam. He could also buy several pairs of socks that exhibited a dominant blue color, one pair with a purple seam, one pair with a red seam and one pair with a yellow-red seam. He could launder all of these socks in the same load of laundry and store them all in the same dresser drawer, and he could readily distinguish the components of each pair of socks from the others.

The preferred embodiment of the invention may also provide a means by which persons in the same household who wear socks of the same color may each distinguish their own socks from the others. Thus, for example, one member of the household could buy blue socks with yellow toe seams, while another member of the household could buy blue socks with red toe seams. In the alternative, each member could buy blue socks with a variety of differently colored toe seams according to the invention, and they could mark the toe seams with an indelible marker, in black or some other further distinguishing color, at a particular location on the seam that is unique for each individual. Thus, for example, one member could mark all his toe seams with a black mark at the center of the toe seam and another could mark all his toe seams with a black mark at each end of the toe seam. Still another could wear socks with unmarked toe seams.

Figure 2:
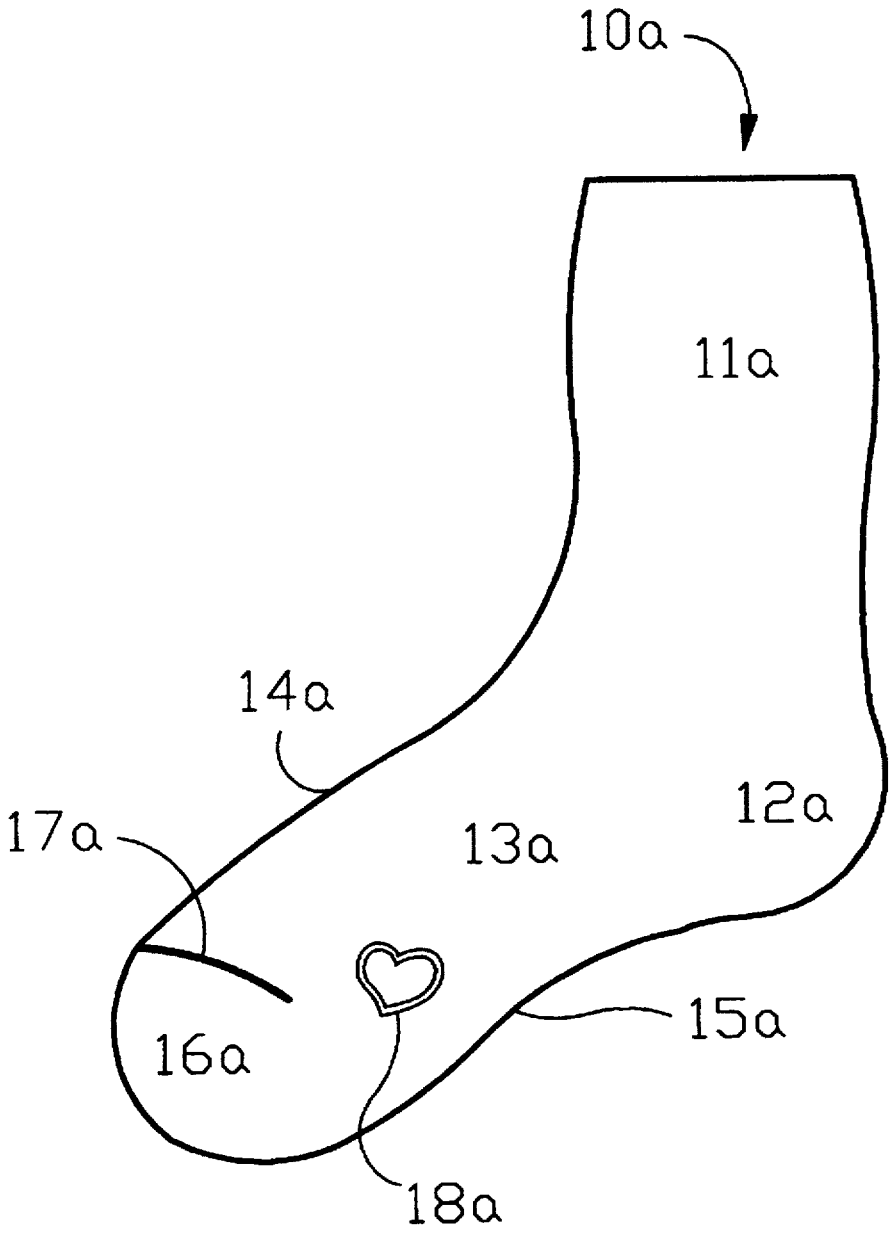
FIG. 2 is a perspective view of a sock which exhibits an alternative embodiment of the invention.

FIG. 2 illustrates an alternative embodiment of the invention in sock 10*a*, which is similar in many respects to sock 10 of FIG. 1. Sock 10*a* therefore includes leg portion 11*a*, heel portion 12*a*, foot portion 13*a*, with the instep indicated at 14*a* and the sole at 15*a*, and toe portion 16*a*. The toe end of sock 10*a* is closed with a stitched toe seam 17*a*. Sock 10*a* also includes as its distinctive color indicator, according to the invention, heart-shaped symbol 18*a*. This symbol is merely illustrative of the many symbols that may be utilized according to the invention to distinguish a sock from others of similar colors, and to facilitate matching of such sock with its mate. Other symbols that may be utilized for this purpose include diamond-shapes, club-shapes, spade-shapes, star-shapes and the like. Symbol 18*a* may be embroidered, stamped or otherwise affixed by any permanent means to the sock. It may also comprise a flexible patch or the like that may be ironed, sewed or glued into place. Symbol 18a is provided, according to the invention, in a distinctive color, preferably having a hue that is different, according to the Munsell system of color classification, from the dominant color of the sock. It will serve as a distinctive color indicator, according to the invention, so long as it is capable of being distinguished by its color, as perceived by the human eye, from the surrounding portion of the sock. When mating components of a pair of socks are each provided with an identical distinctive color indicator, the individual socks can readily be matched with their mates from a group of socks of similar colors.

Of course, symbol 18a may also be distinguished by its shape or its location on the sock from other symbols that may be utilized according to the invention, and these differences may also facilitate matching of socks bearing such symbols with their mates.

Figure 3:
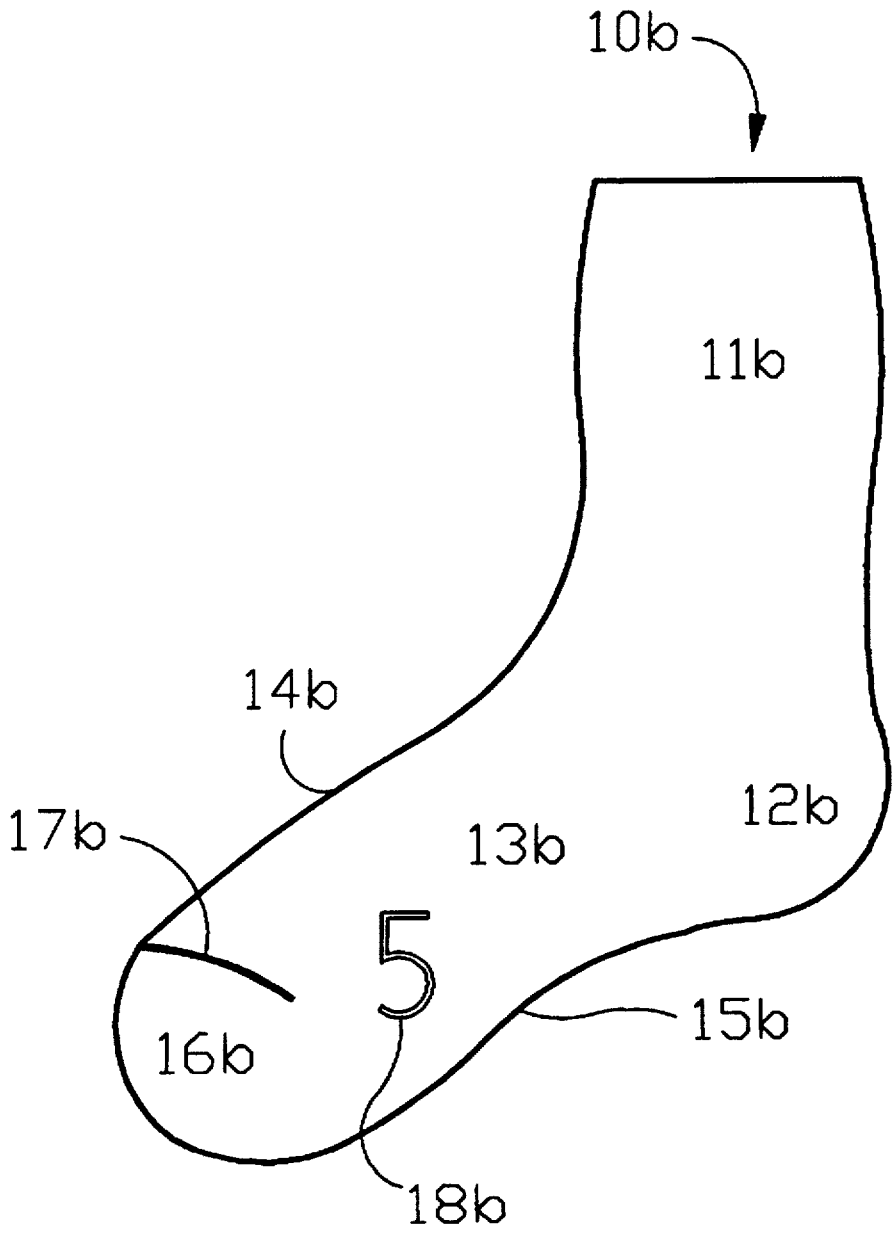
FIG. 3 is a perspective view of a sock which exhibits a second alternative embodiment of the invention.

Another embodiment of the invention is illustrated in FIG. 3, wherein sock 10b is similar in many respects to sock 10 of FIG. 1 and sock 10a of FIG. 2. Sock 10b includes leg portion 11b, heel portion 12b, foot portion 13b, with the instep indicated at 14b and the sole at 15b, and toe portion 16b. The toe end of sock 10b is closed with a stitched toe seam 17b. Sock 10b also includes as its distinctive color indicator, according to the invention, numeral 18b . This numeral, which of course may be of any value, may be embroidered, stamped or otherwise affixed by any permanent means to the sock. It may also comprise a flexible patch or the like that may be ironed, sewed or glued into place. Numeral 18b is provided, according to the invention, in a distinctive color, preferably having a hue that is different, according to the Munsell system of color classification, from the dominant color of the sock. It will serve as a distinctive color indicator, according to the invention, so long as it is capable of being distinguished by its color, as perceived by the human eye, from the surrounding portion of the sock. When mating components of a pair of socks are each provided with an identical distinctive color indicator, the individual socks can readily be matched with their mates from a group of socks of similar colors.

Of course, numeral 18b may also be distinguished by its shape or its location on the sock from other numerals or symbols that may be utilized according to the invention, and these differences may also facilitate matching of socks bearing such numerals or symbols with their mates.

Although this description contains many specifics, these should not be construed as limiting the scope of the invention but as merely providing illustrations of some of the presently preferred embodiments thereof, as well as the best mode contemplated by the inventor of carrying out the invention. The invention, as described herein, is susceptible to various modifications and adaptations, and the same are intended to be comprehended within the meaning and range of equivalents of the appended claims.

What is claimed is:

1. In a process for making pairs of socks of a predetermined size, wherein both socks of each pair exhibit the same dominant first color, which process includes stitching a toe seam into the toe end of each sock, the improvement which comprises:

(a) selecting a number of pairs to be made in a first group;

(b) selecting a second color that may be distinguished from the first color, for the thread that is utilized to form the toe seam for each sock to be made in the first group of pairs; and (c) stitching the toe seam of each of the socks to be made in the first group using thread of the second color;

(d) pairing the socks in the first group;

(e) selecting a number of pairs to be made in a second group;

(f) selecting a third color that may be distinguished from the first and second colors, for the thread that is utilized to form the toe seam for each sock to be made in the second group of pairs;

(g) stitching the toe seam of each of the socks to be made in the second group using thread of the third color;

(h) pairing the socks in the second group.

2. The process of claim 1, wherein the second color is of a different hue, according to the Munsell system of color classification, than the first color, and the third color is of a different hue than the first and second colors.

3. The process of claim 1, wherein the second and third colors are selected from the group consisting of black, white, yellow, green-yellow, green, blue-green, blue, purple-blue, purple, red-purple, red and yellow-red.

4. In a process for making a plurality of pairs of socks of a predetermined size in a series of batches, the improvement which comprises:

(a) selecting a first color for the dominant color exhibited by the socks;

(b) selecting a number of pairs of socks to be made in a first batch;

(c) selecting a second color that may be distinguished from the first color, for a distinctive color indicator to be applied to each sock in the first batch;

(d) permanently affixing to each sock in the first batch, in a location that will be covered by the shoe of the wearer, a distinctive color indicator in the second color;

(e) pairing the socks in the first batch;

(f) selecting a number of pairs of socks to be made in a second batch;

(g) selecting a third color that may be distinguished from the first and second colors, for a distinctive color indicator to be applied to each sock in the second batch;

(h) permanently affixing to each sock in the second batch, in a location that will be covered by the shoe of the wearer, a distinctive color indicator in the third color;

(i) pairing the socks in the second batch.

5. The process of claim 4, wherein the second color is of a different hue, according to the Munsell system of color classification, than the first color, and the third color is of a different color than the first and second colors.

6. The process of claim 4, wherein the second and third colors are selected from the group consisting of black, white, yellow, green-yellow, green, blue-green, blue, purple-blue, purple, red-purple, red and yellow-red.

7. The process of claim 4, wherein each of the socks is generally tube-shaped, the toe end of which is closed with a stitched toe seam, and wherein the color indicator comprises the thread that is utilized to form the toe seam.

* * * * *

US005708984C1

(12) EX PARTE REEXAMINATION CERTIFICATE (5498th)

United States Patent
Shofner

(10) Number: US 5,708,984 C1
(45) Certificate Issued: Sep. 12, 2006

(54) SOCKS WITH COLOR INDICATORS TO FACILITATE MATCHING OF COMPONENTS OF A PAIR

(75) Inventor: Michael Monroe Shofner, 1715 Wartrace Pike, Shelbyville, TN (US) 37160

(73) Assignee: Michael Monroe Shofner, Shelbyville, TN (US)

Reexamination Request:
No. 90/006,821, Oct. 20, 2003

Reexamination Certificate for:

| | |
|---|---|
| Patent No.: | **5,708,984** |
| Issued: | **Jan. 20, 1998** |
| Appl. No.: | **08/721,236** |
| Filed: | **Sep. 26, 1996** |

Related U.S. Application Data

(63) Continuation-in-part of application No. 08/546,603, filed on Oct. 23, 1995, now abandoned.

(51) Int. Cl.
*A41B 11/01* (2006.01)

(52) U.S. Cl. ..... 2/239; 2/275

(58) Field of Classification Search ..... 2/239, 2/409, 275, 241, 242, 244, 246, 243.1; D2/980, D2/991, 994, 985; 24/DIG. 29; 66/178 R, 66/180, 182, 185–187
See application file for complete search history.

(56) References Cited

U.S. PATENT DOCUMENTS

| | | | | | |
|---|---|---|---|---|---|
| 2,002,888 | A | * | 5/1935 | Gastrich | 66/182 |
| 2,569,434 | A | * | 9/1951 | Ischinger | 2/239 |
| 2,621,501 | A | * | 12/1952 | Jenkins | 66/171 |
| 2,798,281 | A | * | 7/1957 | Herzog | 2/239 |
| 2,980,917 | A | * | 4/1961 | Slane | 2/239 |
| 3,142,974 | A | * | 8/1964 | Fregeolle | 66/48 |
| 3,324,686 | A | * | 6/1967 | Rosenstein | 66/187 |
| D208,623 | S | * | 9/1967 | Jensen | D2/994 |
| 4,104,892 | A | * | 8/1978 | Thorneburg | 66/185 |
| 4,513,589 | A | * | 4/1985 | Kearns | 66/180 |
| 4,734,938 | A | * | 4/1988 | Anderson | 2/239 |
| 4,958,388 | A | * | 9/1990 | Madden, III | 2/239 |
| 5,357,660 | A | | 10/1994 | Smith | |
| 5,417,091 | A | * | 5/1995 | Moser | 66/178 R |

OTHER PUBLICATIONS

Gold Toe Fall 1988 Catalog for Weatherbeaters Wool Socks.
Letter of Mar. 24, 1975 From Steve Lowenthal, National Sales Manager of Great American Knitting Mills.
Letter of Feb. 22, 1974 From Steve Lowenthal, National Sales Manager of Great American Knitting Mills.
Gold Toe Fall 1988 Catalog for Jaspe.
Gold Toe Fall 1988 Catalog for Cotton Casual Socks.
Gold Toe Fall 1988 Catalog for Cotton Dress Socks.
Gold Toe Fall 1988 Catalog for GT Plus Socks.
Letter of Jun. 17, 1977 From Frank Bendheim, President of Great American Knitting Mills and a Page Titled "Fall–Winter 1977 Style & Color Changes".
Letter Dated Dec. 15, 1996 From Frank Bendhei, President of Great American Knitting Mills and a Page Titled "Spring–Summer 1977 Style & Color Changes".
Letter Dated Dec. 22, 1975 From Frank Bendheim, President of Great American Knitting Mills and Page Titled "Spring–Summer 1976 Style & Color Changes".
Flyer Dated Feb. 6, 1967 From Great American Knitting Mills.
Gold Toe Fall 1988 Catalog.
Description of Munsell Color System From Kiptron.psyc. Virginia.edu and www.gretagmacbeth.com.

* cited by examiner

*Primary Examiner*—Gloria Hale

(57) ABSTRACT

An improved pair of socks is disclosed for human feet. The improvement comprises providing a distinctive color indicator on each sock of the pair, in a location that will be covered by the shoe of the wearer, to facilitate pairing of the socks which comprise the pair, wherein the color of the indicator is selected so as to be capable of distinguishing the socks of the pair from other socks of similar or like color and of the same size. A process is also disclosed for making pairs of socks of a predetermined size including a color indicator for facilitating pairing of socks.

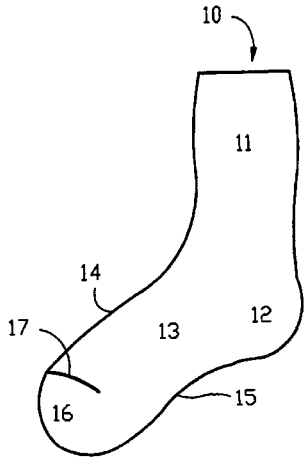

EX PARTE REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

Claims 1–7 are cancelled.

* * * * *